US010759166B2

(12) United States Patent
Kishigami et al.

(10) Patent No.: US 10,759,166 B2
(45) Date of Patent: Sep. 1, 2020

(54) LIQUID EJECTION HEAD AND LIQUID EJECTION APPARATUS

(71) Applicant: BROTHER KOGYO KABUSHIKI KAISHA, Nagoya-shi, Aichi-ken (JP)

(72) Inventors: Toshihiro Kishigami, Obu (JP); Shotaro Kanzaki, Nagoya (JP); Mikio Hirano, Okazaki (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/295,218

(22) Filed: Mar. 7, 2019

(65) Prior Publication Data

US 2019/0299610 A1 Oct. 3, 2019

(30) Foreign Application Priority Data

Mar. 28, 2018 (JP) ..... 2018-062797

(51) Int. Cl.
*B41J 2/14* (2006.01)

(52) U.S. Cl.
CPC ..... *B41J 2/1433* (2013.01); *B41J 2/14201* (2013.01); *B41J 2002/14419* (2013.01)

(58) Field of Classification Search
CPC ..... B41J 2/1433; B41J 2/14201; B41J 2002/14419; B41J 2202/12; B41J 2002/14306; B41J 2/04588; B41J 2/04581; B41J 2/14233
USPC ..... 347/47
See application file for complete search history.

(56) References Cited

U.S. PATENT DOCUMENTS

2007/0008356 A1* 1/2007 Katoh ..... B41J 2/04581 347/10
2007/0176980 A1 8/2007 Lim et al.
2008/0198208 A1* 8/2008 Kyoso ..... B41J 2/14233 347/85
2015/0022593 A1 1/2015 Fukuda

FOREIGN PATENT DOCUMENTS

JP H04-361045 A 12/1992
JP H05-261918 A 10/1993
JP H10-114081 A 5/1998
(Continued)

*Primary Examiner* — Huan H Tran
*Assistant Examiner* — Alexander D Shenderov
(74) *Attorney, Agent, or Firm* — Scully, Scott, Murphy & Presser, P.C.

(57) ABSTRACT

A liquid ejection head includes a manifold configured to store liquid therein, a plurality of ejection channels, and a dummy channel. Each ejection channel communicates with the manifold and is configured to receive liquid from the manifold and eject liquid through a corresponding nozzle thereof open to a nozzle surface. The dummy channel communicates with the manifold and includes a dummy nozzle open to the nozzle surface. The dummy channel further includes a pressure chamber, an actuator configured to apply pressure to liquid in the pressure chamber, a communication passage connecting the manifold to the pressure chamber, and a circulation passage through which the pressure chamber communicates with the manifold. The circulation passage is different from the communication passage and located between the dummy nozzle and the manifold.

20 Claims, 8 Drawing Sheets

(56) References Cited

FOREIGN PATENT DOCUMENTS

| | | | |
|---|---|---|---|
| JP | 2007-203733 | A | 8/2007 |
| JP | 2008-200902 | A | 9/2008 |
| JP | 2015-037863 | A | 2/2015 |

* cited by examiner

LIQUID EJECTION HEAD AND LIQUID EJECTION APPARATUS

CROSS-REFERENCE TO RELATED APPLICATION

This application claims priority from Japanese Patent Application No. 2018-062797 filed on Mar. 28, 2018, the content of which is incorporated herein by reference in its entirety.

FIELD OF DISCLOSURE

Aspects disclosed herein relate to a liquid ejection head and a liquid ejection apparatus including a liquid ejection head.

BACKGROUND

A known liquid ejection apparatus includes a liquid ejection head configured to eject liquid, such as ink, to a recording medium. The liquid ejection head includes a manifold for storing liquid therein, and ejection channels to which liquid is supplied from the manifold. Each ejection channel includes a pressure chamber and a nozzle. Upon application of pressure to liquid in the pressure chamber, liquid is ejected from the nozzle.

The ejection channels are arranged in an array. A dummy channel is provided next to an ejection channel at an end of the array. This allows the ejection channels in the middle of the array and the ejection channel at the end of the array to have a similar surrounding structure to each other, and thus makes the ejection characteristics uniform among the ejection channels.

SUMMARY

It is conceivable to provide a nozzle for the dummy channel in addition to the nozzles of the ejection channels so that, through all theses nozzles located downstream, liquid in an upstream tank connected to the manifold is drawn into and spread throughout the manifold. In this case, liquid in the dummy channel near the nozzle is exposed to the atmosphere and may change in quality over time.

It may be beneficial for a liquid ejection head and a liquid ejection apparatus to include a dummy channel which has a nozzle and is configured to prevent or suppress deterioration in quality of liquid therein.

According to one or more aspect of the disclosure, a liquid ejection head comprises a manifold configured to store liquid therein, a plurality of ejection channels, and a dummy channel. Each ejection channel communicates with the manifold and is configured to receive liquid from the manifold and eject liquid through a corresponding nozzle thereof open to a nozzle surface. The dummy channel communicates with the manifold and includes a dummy nozzle open to the nozzle surface. The dummy channel further includes a pressure chamber, an actuator configured to apply pressure to liquid in the pressure chamber, a communication passage connecting the manifold to the pressure chamber, and a circulation passage through which the pressure chamber communicates with the manifold. The circulation passage is different from the communication passage and located between the dummy nozzle and the manifold.

According to one or more aspect of the disclosure, a liquid ejection apparatus comprises the above-described liquid ejection head and a driver integrated circuit. The driver integrated circuit is configured to output a drive signal for driving the actuator. The drive signal is a pulse signal changing between a first potential v1 and a second potential v2. The pressure chamber of the dummy channel is configured to have a first volume V1 when the drive signal applied to the actuator is at a first potential v1, and have a second volume V2 less than the first volume V1 when the drive signal applied to the actuator is at the second potential v2. An inertance of a path located toward the circulation passage relative to the pressure chamber is different from an inertance of a path toward the communication passage relative to the pressure chamber. The driver integrated circuit is configured to output to the actuator a drive signal which takes a first time period t12 to change from the first potential v1 to the second potential and takes a second time period t21 to change from the second potential v2 to the first potential v1. The first time period t12 is different from the second time period t21.

According to one or more aspect of the disclosure, a liquid ejection head comprises a plurality of nozzles open to a nozzle surface, a manifold communicating with the plurality of nozzles, a plurality of pressure chambers, a plurality of channels, and a plurality of actuators. Each channel includes a communication passage which connects a corresponding outlet of the manifold to a corresponding pressure chamber, and each channel extends from the corresponding outlet of the manifold, via the communication passage, to a corresponding nozzle. Each actuator partially defines a wall of a corresponding pressure chamber and is configured to change a volume of the corresponding pressure chamber. The plurality of channels are arranged in an array, and a channel located at an end of the array is a dummy channel. The dummy channel defines a path extending from a corresponding outlet of the manifold to a corresponding nozzle and includes, in addition to a corresponding communication passage, a circulation passage which is located between the corresponding nozzle and the manifold and through which a corresponding pressure chamber communicates with the manifold.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

First Embodiment

A liquid ejection head and a liquid ejection apparatus according to embodiments will be described with reference to the drawings. An example of a liquid ejection apparatus is configured to eject ink onto a recording sheet, as will be described hereinafter. However, the liquid ejection apparatus may eject liquid other than ink, and ejected liquid may be adhered onto a medium other than a sheet-like medium.

[Structure of Liquid Ejection Apparatus]

Figure 1:
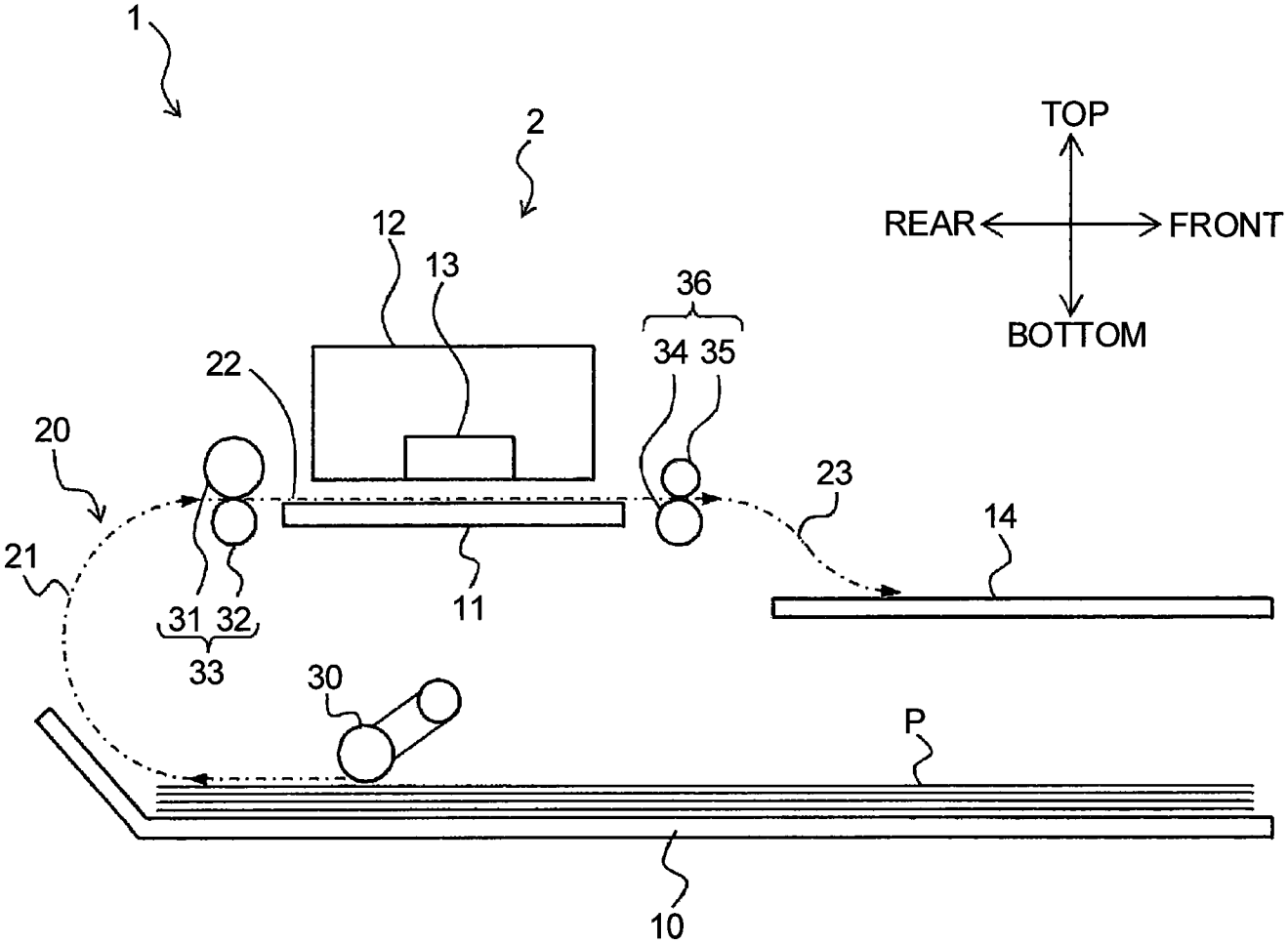
FIG. 1 shows a schematic diagram showing an overall structure of a liquid ejection apparatus in a first embodiment according to one or more aspects of the disclosure.

As shown in FIG. 1, a liquid ejection apparatus 1 includes a feed tray 10, a platen 11, and a carriage 12 which are assembled from below in this order. The feed tray 10 stores a plurality of recording sheets P therein. The platen 11 is elongate in a right-left direction and is disposed above the feed tray 10. The platen 11 is a flat plate and supports from below a recording sheet being conveyed. The carriage 12 is disposed above the platen 11. The carriage 12 is movable reciprocally in the right-left direction and supports a liquid ejection head 13. A discharge tray 14 is disposed further toward the front than the platen 11 and receives a recording sheet P having an image recorded thereon.

A sheet conveying path 20 is defined to extend rearward from the feed tray 10 to the discharge tray 14. The sheet conveying path 20 includes a curved path portion 21, straight path portion 22, and an end path portion 23. The curved path portion 21 is curved upward from the feed tray 10 and extends to a position near the rear of the platen 11. The straight path portion 22 extends from an end of the curved path portion 21 to a position near the front of the platen 11. The end path 23 extends from an end of the straight path portion 22 to the discharge tray 14.

The liquid ejection apparatus 1 includes, as a sheet conveying mechanism for conveying a recording sheet P, a feed roller 30, conveying roller 30, and a discharge roller 34. The sheet conveying mechanism conveys a recording sheet P from the feed tray 10 to the discharge tray 14 along the sheet conveying path 20.

Specifically, the feed roller 30 is disposed directly above the feed tray 10 and contacts an uppermost sheet P. A conveying roller pair 33, including the conveying roller 31 and a pinch roller 32, is disposed near a downstream end of the curved path portion 21. The conveying roller pair 33 is disposed between the curved path portion 21 and the straight path portion 22. A discharge roller pair 34, including the discharge roller 34 and a spur roller 32, is disposed near a downstream end of the straight path portion 22. The discharge roller pair 36 is disposed between the straight path portion 22 and the end path portion 23.

The feed roller 30 feeds a recording sheet P along the curved path portion 21 toward the conveying roller pair 33. The conveying roller pair 33 conveys the recording sheet P along the straight path portion 22 to the discharge roller pair 36. The liquid ejection head 13 ejects ink onto the recording sheet P supported on the platen 11 and conveyed along the straight path portion 22, thereby recording an image on the recording sheet P. The discharge roller pair 36 conveys the recording sheet P having the image recorded thereon to the discharge tray 14.

Figure 2:
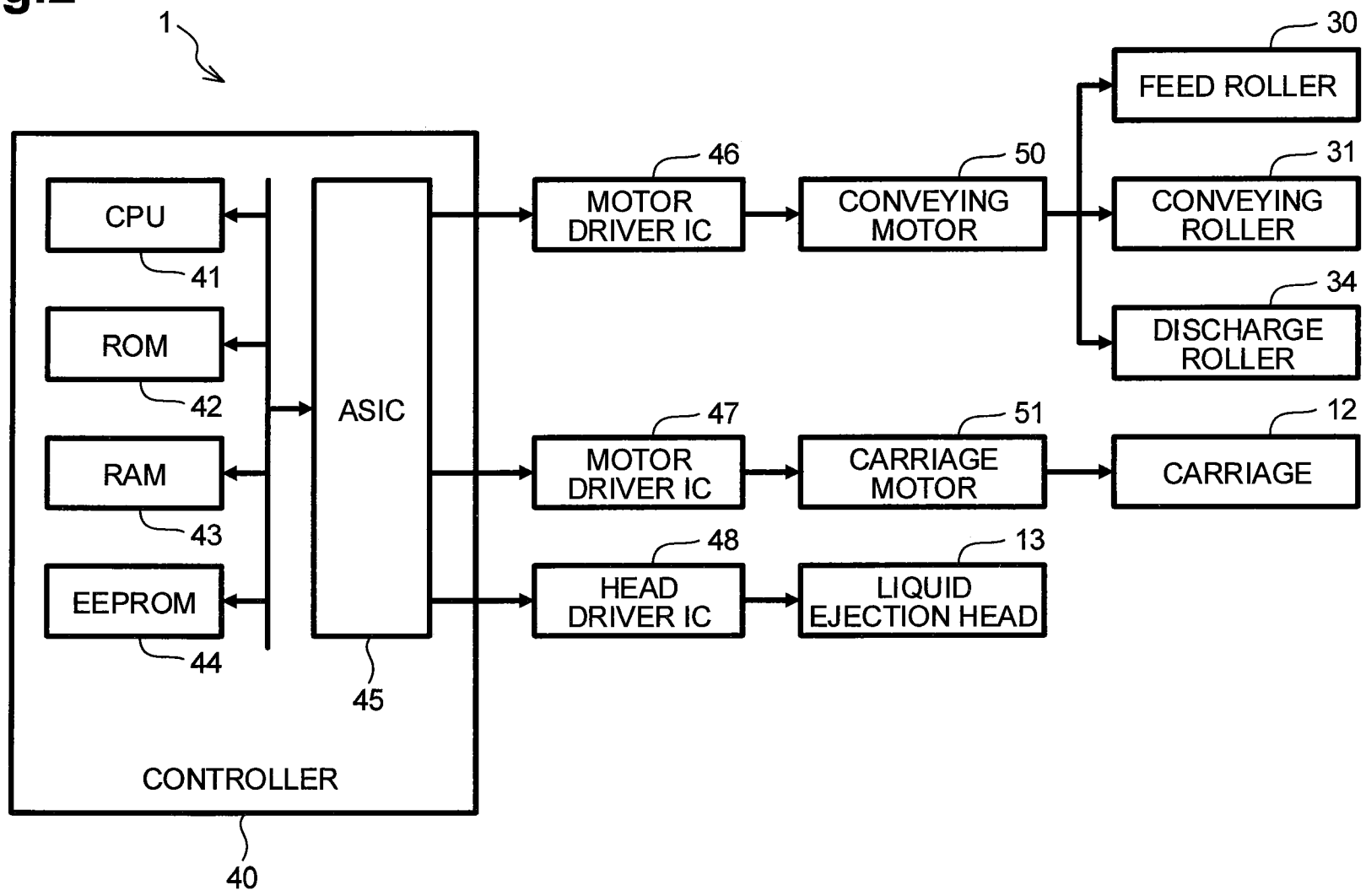
FIG. 2 is a block diagram showing a functional structure of the liquid ejection apparatus.

As shown FIG. 2, a controller 40 of the liquid ejection apparatus 1 includes a first substrate and a second substrate. A central processing unit (CPU) 41, a read-only memory (ROM) 42, a random-access memory (RAM) 43, and an electrically erasable programmable ROM (EEPROM) 44 are mounted on the first substrate. An application specific integrated circuit (ASIC) 45 is mounted on the second substrate. Two motor driver integrated circuits (ICs) 46, 47 and a head driver integrated circuit (IC) 48 are connected to the ASIC 45. The motor driver IC 46 drives a conveying motor 50, and the motor driver IC 47 drives a carriage motor 51. The head driver IC 48 drives actuators 71, 81 (to be described later) of the liquid ejection head 13.

When the liquid ejection apparatus 1 receives an input of a print job from a user or a communication device, the CPU 41 outputs to the ASIC 45 a command for executing the print job based on a program stored in the ROM 42. The ASIC 45 controls the driver ICs 46-48 based on this command. Consequently, a recording sheet P is fed, and recording is executed by ink ejection onto the recording sheet P in synchronization with conveyance of the recording sheet P.

Specifically, the motor driver IC 46 drives the conveying motor 50 to rotate the feed roller 30, the conveying roller 34, and the discharge roller 34. The motor driver IC 47 drives the carriage motor 51 to reciprocate the carriage 12 in the right-left direction (e.g., in a main scanning direction). The head driver IC 48 selectively drives the actuators 71, 81 to cause vibration of menisci and ink ejection.

The head driver IC 48 outputs a drive signal which is a pulse signal changing between a first potential v1 and a second potential v2 different from the first potential v1. When the drive signal is of the first potential v1, a pressure chamber has a first volume V1. When the drive signal is of the second potential v2, the pressure chamber has a second volume V2 which is less than the first volume V1 (V1>V2). As described above, upon application of a drive signal to an actuator, the actuator deforms thereby changing the volume of a pressure chamber.

The liquid ejection apparatus 1 further includes various sensors, such as a sheet edge sensor for detecting the position of a recording sheet, and an encoder for detecting the position of the carriage. The controller 40 controls the driver ICs 46-48, based on signals from the various sensors, for image forming on a recording sheet P.

[Structure of Liquid Ejection Head]

Figure 3:
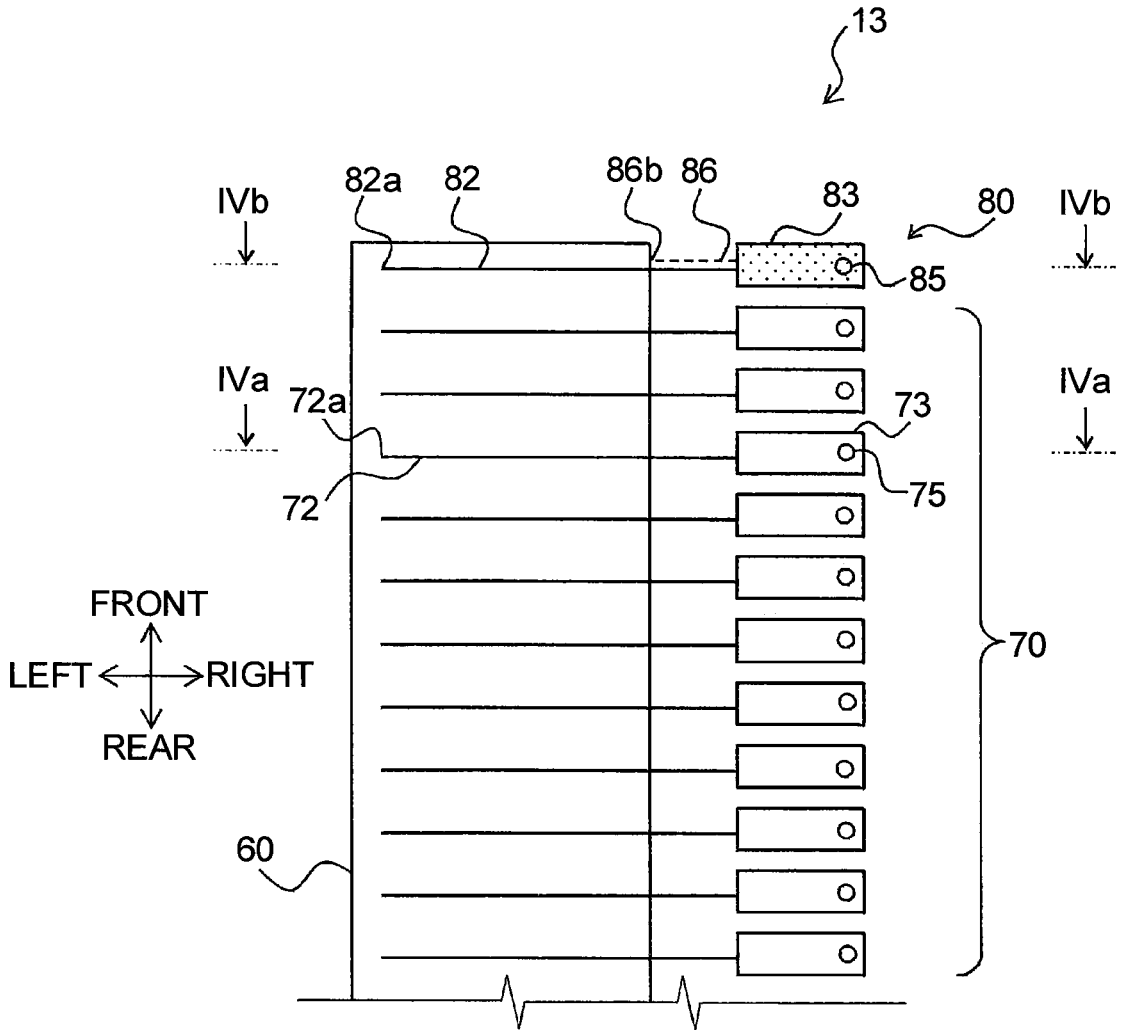
FIG. 3 is an enlarged plan view of a part of a liquid ejection head in the first embodiment.

As shown in FIG. 3, the liquid ejection head 13 includes a manifold 60 for temporally storing ink, and ejection channels 70 and a dummy channel 80 to which ink is distributed from the manifold 60. The manifold 60 is elongate in a front and rear direction (e.g., in a sub-scanning direction) and defines a rectangular parallelepiped space.

The manifold 60 is greater in size than other channel elements located downstream of the manifold 60 in an ink flow direction toward each nozzle. Thus, the manifold 60 has a less ink flow resistance than the other channel elements, such as a pressure chamber 73, a descender 74, and an ejection nozzle 75. A supply passage extending from a liquid tank (not shown) is connected to the rear (upstream end) of the manifold 60.

The liquid ejection head 13 includes the ejection channels 70 and the dummy channel 80 arranged as shown in FIG. 3. Each channel 70, 80 partially overlaps with the manifold 60 in a top-bottom direction and is disposed on one of opposite sides (e.g., on the right side in FIG. 3) of the manifold 60 in the right-left direction. The channels 70, 80 are equally spaced with each other in the front-rear direction and arranged along the manifold 60 to form an array of channels. The dummy channel 80 is located at an end of the array of channels.

Figure 4A:
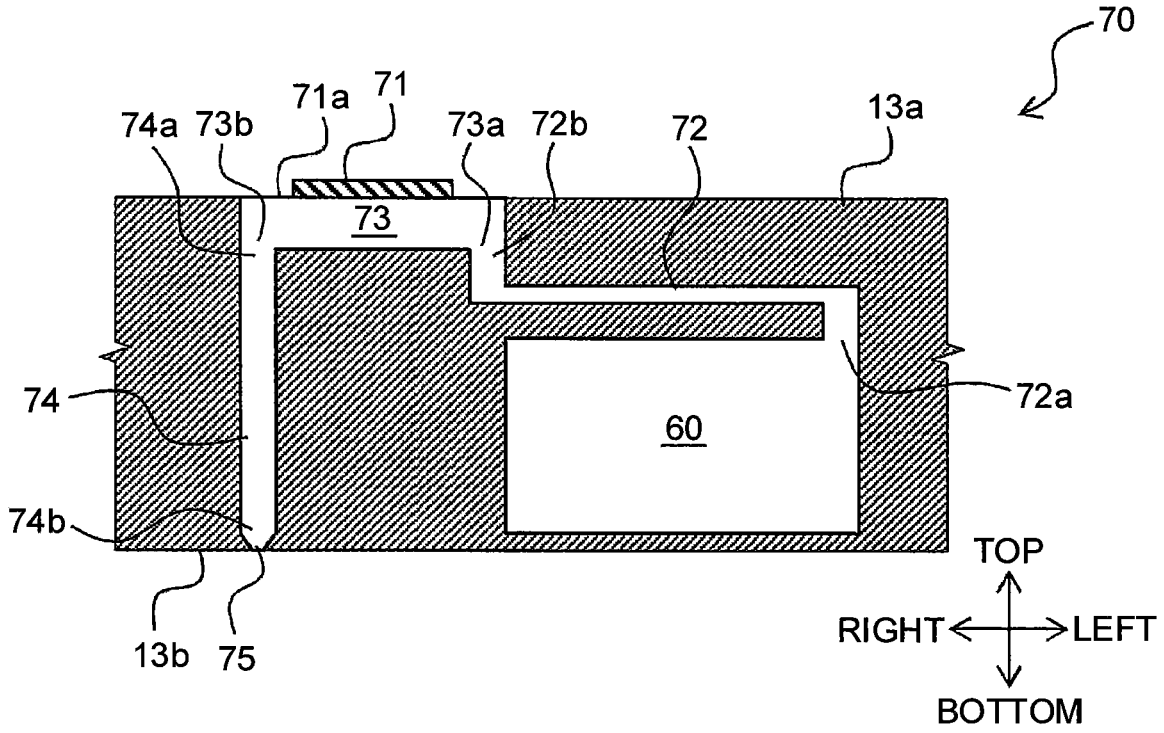
FIG. 4A is an enlarged cross-sectional view of an ejection channel of the liquid ejection head, cut along line IVa-IVa in FIG. 3.
Figure 4B:
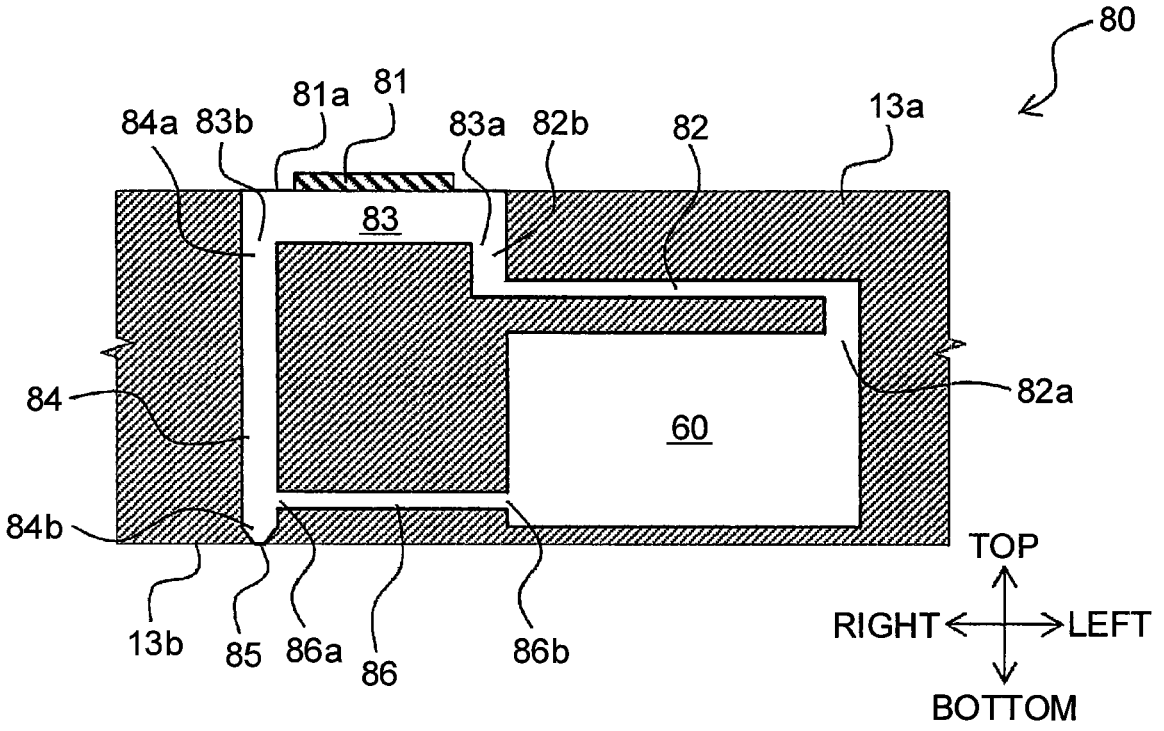
FIG. 4B is an enlarged cross-sectional view of a dummy channel of the liquid ejection head, cut along line IVb-IVb in FIG. 3.

FIGS. 4A and 4B each also show a cross-sectional view of the manifold 60 cut in its longitudinal direction.

As shown in FIGS. 4A and 4B, the ejection channels 70 and the dummy channel 80 share the manifold 60. Each channel 70, 80 has a common structure where an outlet of the manifold 60 is fluidly connected to a communication passage, a pressure chamber, a descender, and a nozzle sequentially. As another common structure, a wall of each pressure chamber 70, 80 is partially defined by an actuator 71, 81.

Each actuator 71, 81 includes a piezoelectric element and a vibration plate which are stacked one on another. The piezoelectric element includes a piezoelectric layer and electrodes (an individual electrode and a common electrode) laminated on the top and bottom of the piezoelectric layer. Upon application of a drive voltage to the piezoelectric element, the piezoelectric element expands and contracts in its surface direction (e.g., in a direction orthogonal to the top-bottom direction). The vibration plate does not deform by itself, and the actuator shifts toward the pressure chamber.

As shown in FIG. 4A, the ejection channel 70 defines a passage extending from an outlet of the manifold 60, via a communication passage 72, a pressure chamber 73, and a descender 74, to an ejection nozzle 75. The communication passage 72 connects the manifold 60 to the pressure chamber 73. The descender 74 connects the pressure chamber 73 to the ejection nozzle 75. As described above, a vibration plate 71*a* of an actuator 71 partially defines a wall of the pressure chamber 73. Upon application of a drive voltage to the actuator 71, the vibration plate 71*a* is deformed by the actuator 71, thereby ejecting ink from the pressure chamber 73.

More specifically, the communication passage 72 is a crank-shaped narrow passage and has a relatively high ink flow resistance. The communication passage 72 directly connects an upper portion of the manifold 60 to a lower portion of the pressure chamber 73. One end 72*a* of the communication passage 72 corresponds to the outlet of the manifold 60 and is connected, from above, to a left end of the manifold 60. The communication passage 72 extends upward from one end 72*a* and is bent to the right. Then, the communication passage 72 is bent upward at a position near a right end of the manifold 60 and extends to the other end 72*b*. The other end 72*b* of the communication passage 72 is connected, from below, to one end 73*a* of the pressure chamber 73.

The pressure chamber 73 is elongate in the right-left direction and defines a space extending rightward from the one end 73*a* to the other end 73*b*. The pressure chamber 73 is open upward and, as described above, is sealed with the vibration plate 71*a*.

The descender 74 is a substantially straight passage and connects a lower portion of the pressure chamber 73 to the ejection nozzle 75. One end 74*a* of the descender 74 is connected, from below, to the other end 73*b* of the pressure chamber 73. The descender 74 extends downward from the one end 74*a* to the other end 74*b*. The other end 74*b* is connected to the ejection nozzle 75. The descender 74 allows the manifold 60 to be relatively deep and have a relatively low ink flow resistance.

The actuator 71, when driven, pressurizes ink in the pressure chamber 73, thereby ejecting ink from the ejection nozzle 75.

As shown in FIG. 4B, the dummy channel 80 extends from an outlet of the manifold 60, via a communication passage 82, a pressure chamber 83, and a descender 84, to a dummy nozzle 85. Channel elements of the dummy channel 80, including an actuator 81 and the communication passage 82, are similar in disposition to those of the ejection channel 70. Similarly to the actuator 71, a vibration plate 81*a* of the actuator 81 partially defines a wall of the pressure chamber 83. The actuator 81, when energized, deforms to change the volume of the pressure chamber 83.

Further, the dummy channel 80 is characterized by a circulation passage 86. The pressure chamber 83 is in fluid communication with the manifold 60 through the circulation passage 86. The circulation passage 86 is located between the dummy nozzle 85 and the manifold 60. The circulation passage 86 is closer to the dummy nozzle 85 than to the actuator 81. Specifically, the circulation passage 86 connects the descender 84 to the manifold 60. Note that the communication passage 82 is connected to one end of the pressure chamber 83, the one end being opposite from the dummy nozzle 85 relative to the actuator 81.

The presence of the descender 84 enables increase in volume of the manifold 60, reliable dilution of ink flowing into the circulation passage 86, and supply of fresh ink into the communication passage 82.

One end 86*a* of the circulation passage 86 is connected to a portion of the descender 84, the portion being near the other end 84*b* of the descender 84. The circulation passage 86 extends leftward from the one end 86*a* to the other end 86*b*. The other end 86*b* is connected to a lower right end of the manifold 60.

A laminate body 13*a* is formed by laminating a plurality of plates having through-holes, dents, and grooves. The laminate body 13*a* defines therein channel elements such as the manifold 60, the communication channels 72, 82, and the pressure chambers 73, 83. A lower surface 13*b* of the laminate body 13*a* is a nozzle surface 13*b* to which the nozzles 75, 85 are open. The boundaries (bonded surfaces) of the plates forming the laminate body are omitted from FIGS. 4A and 4B.

The ejection channels 70 in the channel array are same in size of the communication passage 72, the pressure chamber 73, the descender 74, and the ejection nozzle 75. These elements of each ejection channel 70 are almost same in size as corresponding elements of the dummy channels 80.

As described above, the dummy channel 80 is disposed adjacent to an ejection channel 70 located at a far end of the channel array. This structure enables unifying the ejection characteristics among the ejection channel 70 at the far end and the other ejection channels 70.

Ink in the dummy channel 80 is exposed to the atmosphere through the dummy nozzle 85 and may change in quality (e.g., in viscosity) with time. In this embodiment, however, the circulation passage 86 allows ink in the dummy channel 80 to flow back into the manifold 60 when the actuator 81 is driven to such extent as not to cause ink ejection. Ink in the dummy channel 80 is maintained as fresh as ink in the manifold 60. This prevents thickened ink in the dummy channel 80 from affecting the ejection characteristics of the adjacent ejection channel 70.

In the liquid ejection head 13 in this embodiment, the manifold 60 has opposite ends (left and right ends) in a cross section (shown in FIG. 4B) intersecting the longitudinal direction (the front-rear direction) of the manifold 60. In the dummy channel 80, the other end 86*b* of the circulation passage 86 is connected to the right end of the manifold 60, and the one end 82*a* of the communication passage 82 is connected to the left end of the manifold 60.

The dummy channel 80 is connected to the manifold 60 at two different positions, namely at the left and right ends of the cross section of the manifold 60. This prevents ink returning into the manifold 60 from flowing immediately to the circulation passage 86 of the dummy channel 80. Thus, deterioration in quality of ink in the dummy channel 80 is prevented or suppressed.

[Structure Unique to Dummy Channel]

As described above, the elements of the dummy channel 80 in this embodiment are almost same in size as the corresponding elements of the ejection channel 70. However, the dummy channel 80 has a unique structure different from that of the ejection channel 70, as described in detail below.

In the dummy channel 80, a liquid inertance Mc of the circulation passage 86 is set to be less than a liquid inertance Mn of the dummy nozzle 85. A liquid inertance of a passage is expressed by the following equation (1):

$$M=\rho*l/S \quad (1)$$

where M is the inertance, ρ is the density of liquid, l is the length of a passage, and S is the cross-sectional area of the passage.

In the dummy channel 80, Mc is set to be less than Mn (Mn>Mc). Because of this setting, ink near the dummy nozzle 85 is more likely to move to the circulation passage 86 than to the dummy nozzle 85 when ink flows from the pressure chamber 83 toward the dummy nozzle 85. Ink ejection from the dummy nozzle 85 is restricted in this way. As apparent from the equation (1), the inertance is adjustable by appropriately setting the diameter and the length of a target passage.

Further, the ink flow resistance of the dummy channel 80 is set to be equal to the ink flow resistance of the ejection channel 70. For example, because the circulation passage 86 additionally provided in the dummy channel 80 decreases the ink flow resistance, the cross-sectional area of the communication passage 82 or the dummy nozzle 85 may be set to be less than that of the communication passage 72 or the ejection nozzle 75 of the ejection channel 70.

This setting prevents or reduces outflow of fresh ink from any nozzle having less flow resistance when ink is purged from the nozzles and when ink is initially drawn to the nozzles. Thus, wasteful ink ejection is prevented or reduced.

The flow resistance of the dummy channel 80 being "equal" to that of the ejection channel 70 does not necessarily mean that the flow resistance of the dummy channel 80 being "exactly equal" to that of the ejection channel 70. Specifically, if the flow resistance of the dummy channel 80 is within plus and minus 10% of that of the average flow resistance of the ejection channels 80, the flow resistance of the dummy channel 80 may be regarded as equal to that of the ejection channel 70. The ejection channels 70 have a common design value in terms of the flow resistance.

[Liquid Circulation Direction]

The liquid ejection head 13 in this embodiment is configured such that ink circulates between the dummy channel 80 and the manifold 60. Ink in the manifold 60 flows to the communication passage 82, the pressure chamber 83, the descender 84, and back to the manifold 60, as described in detail below.

With respect to an ink circulation direction, the dummy channel 80 may be divided into three portions, namely the pressure chamber 83, an inflow path upstream of the pressure chamber 83, and an outflow path downstream of the pressure chamber 83. An inertance Mo of the outflow path is set to be less than an inertance Mi of the inflow path (Mo<Mi).

The outflow path is a path located toward the descender 84 (and the circulation passage 86) relative to the pressure chamber 83. More specifically, the outflow path extends from an outlet of the pressure chamber 83, via the descender 84 and the circulation passage 86, to the manifold 60. The inflow path is a path located toward the communication passage relative to the pressure chamber 83. More specifically, the inflow path extends from an outlet of the manifold 60, via the communication passage 82, to the pressure chamber 83.

Figure 5A:
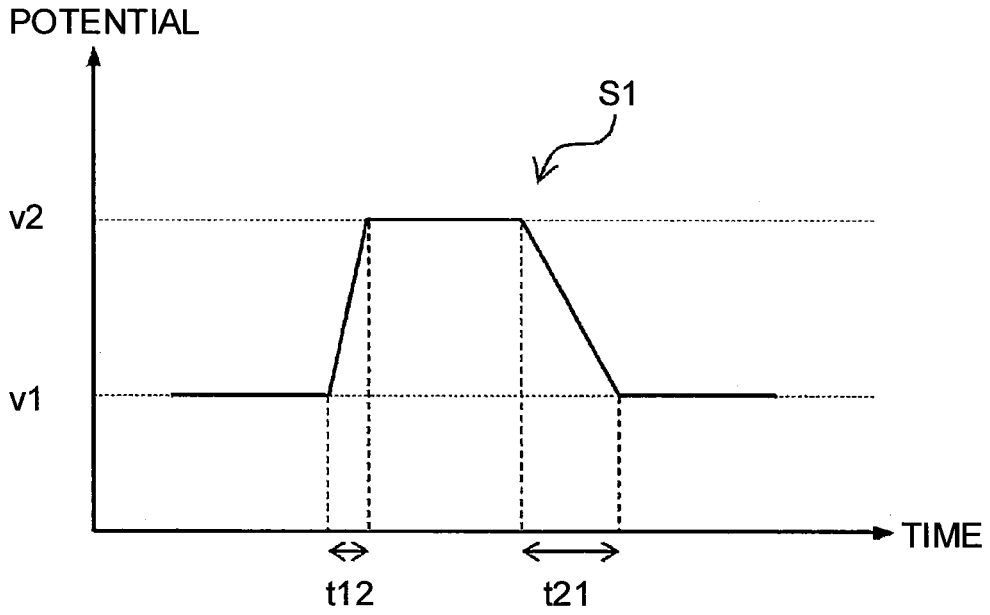
FIGS. 5A and 5B are diagrams each showing the change with time in potential of a drive signal applied to an actuator of the dummy channel.

The head driver IC 48 is configured to output a drive signal S1 shown in FIG. 5A. As described above, the drive signal S1 is a pulse signal changing between the first potential v1 and the second potential v2. The drive signal S1 takes a time period t12 to change from the first potential v1 to the second potential v2, and takes a time period t21 to change from the second potential v2 to the first potential v1. The time period t12 is less than the time period t21 (t12<t21).

This setting allows liquid in the dummy channel 80 to move to the pressure chamber 83, the descender 84, and the circulation passage 86 sequentially. Consequently, deteriorated ink near the dummy nozzle 85 is replaced with fresh ink in the manifold 60.

The liquid circulation direction is determined in the above-described structure by the following fact: there is a greater difference, between the two paths having different ink inertances, in the movement of ink in response to a volume change of a pressure chamber when the pressure change due to the volume change is rapid than when moderate.

A difference in the outflow path having a less inertance between the ink moving amount upon a change from the first potential v1 to the second potential v2 and the ink moving amount upon a change from the second potential v2 to the first potential v1 is greater than a difference in the inflow path having a greater inertance between the ink moving amount upon a change from the first potential v1 to the second potential v2 and the ink moving amount upon a change from the second potential v2 to the first potential v1. Thus, when the drive signal changes from the first potential v1, via the second potential v2, back to the first potential v1, a relatively big ink flow occurs from the manifold 60 toward the pressure chamber 83. As a result, in the dummy channel 80, ink moves from the pressure chamber 83, via the descender 84, to the circulation passage 86 sequentially.

The magnitude relation between the inertances Mo and Mi, and the magnitude relation between the time periods t12 and t21 may be set reversely.

Figure 5B:
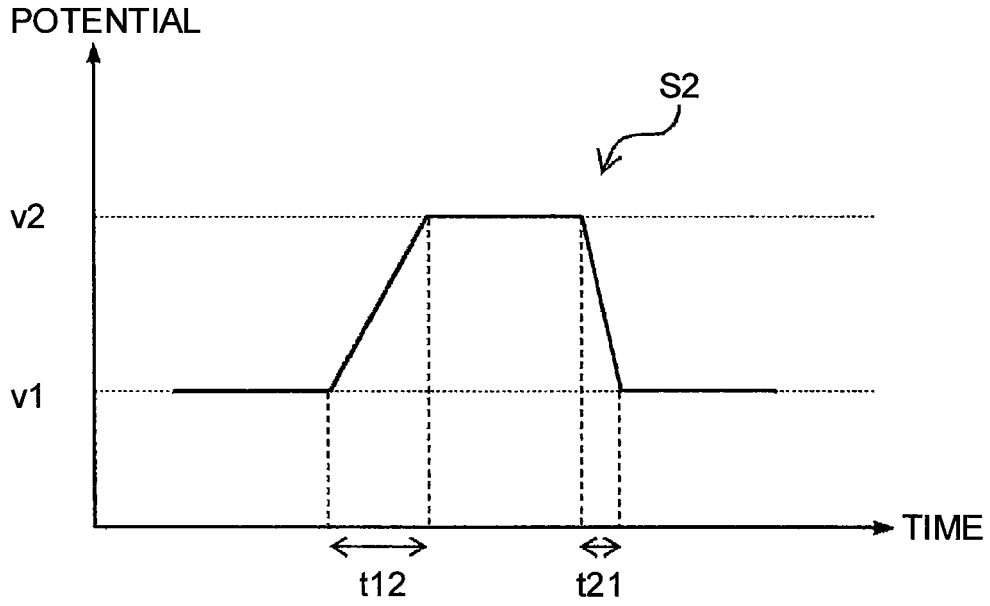

Specifically, the inertance Mo may be greater than the inertance Mi (Mo>Mi) in the dummy channel 80. Further, the head driver IC 48 may be controlled to output a drive signal S2 shown in FIG. 5B. The drive signal S2 may change in potential over a time period t12 and a time period t21 which is less than the time period t12 (t12>t21).

Such settings also allow liquid in the dummy channel 80 to move from the pressure chamber 83, via the descender 84, to the circulation passage 86 sequentially.

Alternatively, the time period t12 may be greater than the time period t21 (t12>t21) while the inertance Mo is less than the inertance Mi (Mo>Mi). In this case, ink in the dummy channel 80 moves in a reverse direction, from the pressure chamber 83, via the communication passage 72, the manifold 60, and the circulation passage 86, to the descender 84.

The above-description referring to FIG. 5 is given on the premise that a positive pressure is applied to the pressure chamber 83 during the time period t12 in which the potential changes from the first potential v1 to the second potential v2 which is greater than v1. However, the actuator 81 may be configured to apply a positive pressure to the pressure chamber 83 during the time period t21 in which the potential changes from the second potential v2 to the first potential v1.

In this case, when the inertance Mo is less than the inertance Mi (Mo<Mi) in the dummy channel 80, the time period t21 for application of a positive pressure should be less than the time period t12 (t12>t21). Alternatively, when the inertance Mo is greater than the inertance Mi (Mo>Mi), the time period t21 should be greater than the time period t12 (t12<t21). In either case, ink in the dummy channel 80, ink in the dummy channel 80 moves from the pressure chamber 80, via the descender 84, to the circulation passage 86 sequentially.

Second Embodiment

A liquid ejection head 131 in a second embodiment shown in FIG. 6 has substantially the same structure as the liquid ejection head 13 in the first embodiment shown in FIG. 3, except for a few points described below.

Figure 6:
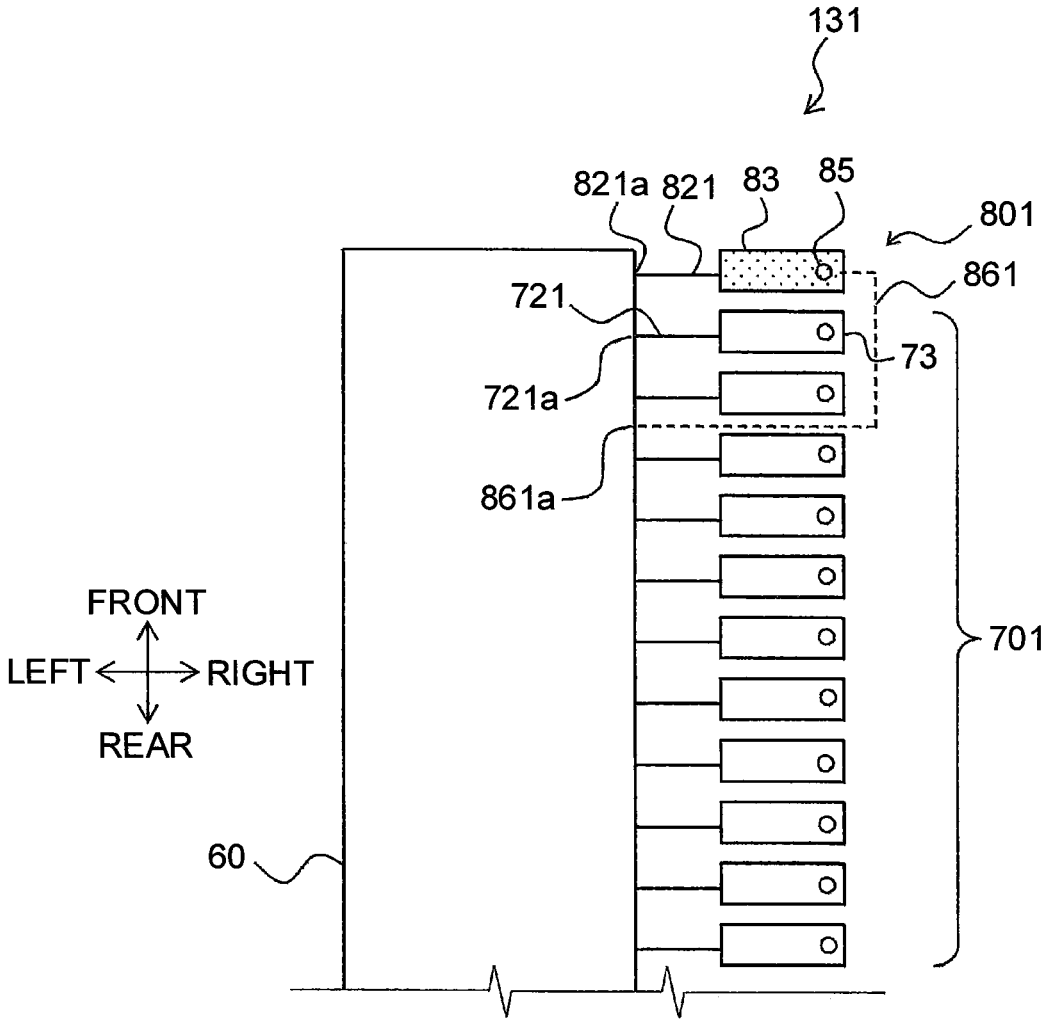
FIG. 6 is an enlarged plan view of a part of a liquid ejection head in a second embodiment according to one or more aspects of the disclosure.

As shown in FIG. 6, an end of a communication passage 721 of each ejection channel 701 is connected to a right end of a manifold 60. Similarly, an end 821*a* of a communication passage 821 of a dummy channel 801 is connected to the right end of the manifold 60.

The dummy channel 801 is distinctive in the connecting position of an end 861*a* of a circulation passage 861 and the manifold 60. One or more connecting positions of ejection channels 701 (ends 721*a* of communication passages 721) to the manifold 60 are positioned between the connecting position of the end 821*a* of the communication passage 821 of the dummy channel 801 to the manifold 60, and the connecting position of the end 861*a* of the circulation passage 861 of the dummy channel 801 to the manifold 60. As shown in FIG. 6, two ends 721*a* of two communication passages 721 of two ejection channels 701 are positioned between the end 821*a* of the communication passage 821 and the end 861*a* of the circulation passage 861 of the dummy channel 801. In this case, the presence of a descender is not essential.

In the dummy channel 801, the connecting position of the circulation passage 861 to the manifold 60 is away, in a longitudinal direction of the manifold 60, from the connecting position of the communication passage 821 to the manifold 60.

Ink returned from the dummy channel 801 to the manifold 60 is readily diluted with ink in the manifold 60, and is prevented from flowing immediately back to the dummy channel 801. Further, when the ejection channels 701 positioned between the two connecting positions are driven, the returned ink is partially used for image forming. Thus, ink in the dummy channel 801 is reliably prevented from thickening.

Third Embodiment

A liquid ejection head 132 in a third embodiment shown in FIG. 7 has substantially the same structure as the liquid ejection head 13 in the first embodiment shown in FIG. 3, except for a few points described below.

Figure 7:
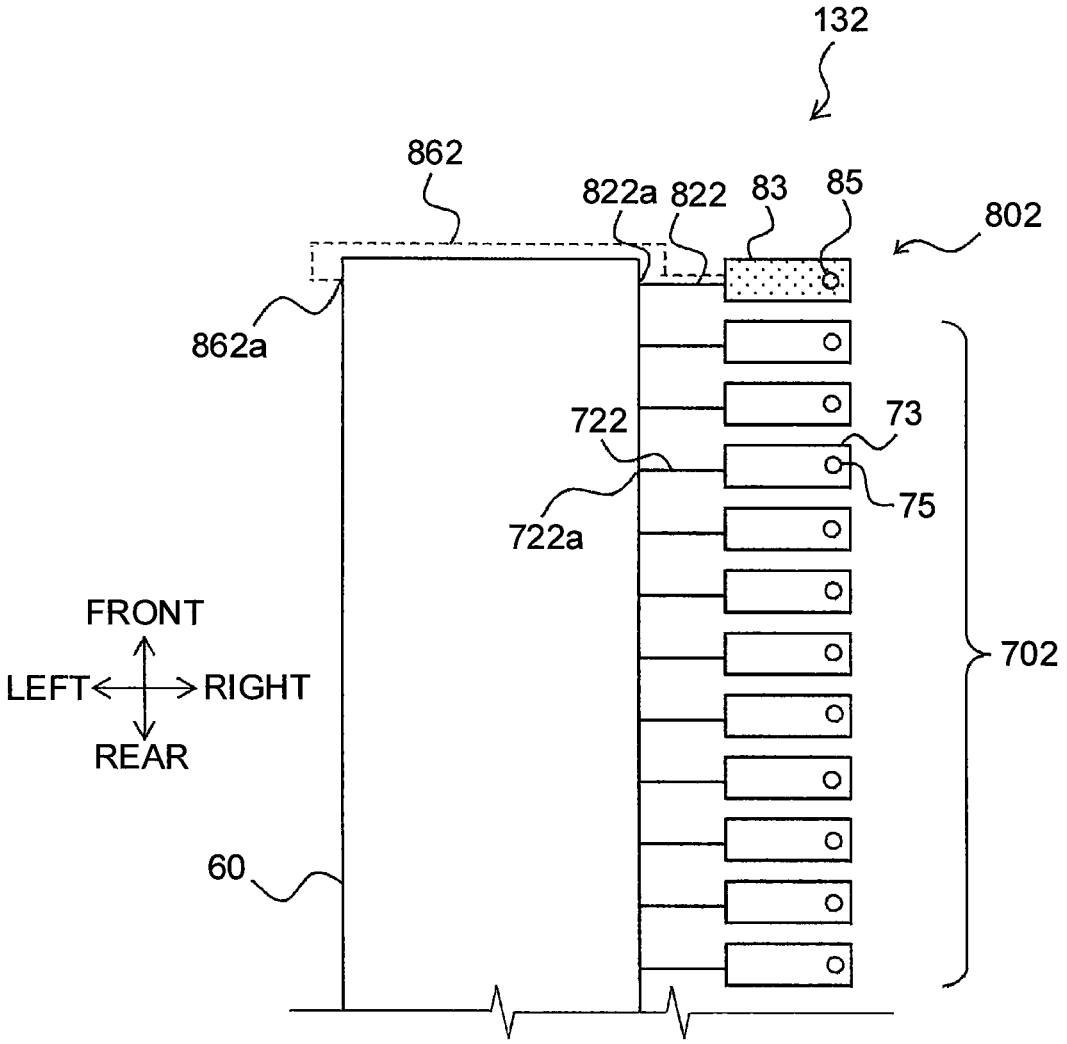
FIG. 7 is an enlarged plan view of a part of a liquid ejection head in a third embodiment according to one or more aspects of the disclosure.

As shown in FIG. 7, an end of a communication passage 722 of each ejection channel 702 is connected to a right end of a manifold 60. Similarly, an end 822*a* of a communication passage 822 of a dummy channel 802 is connected to the right end of the manifold 60.

A circulation passage 862 of the dummy channel 802 is connected to a left end of the manifold 60. In this embodiment, the circulation passage 862 extends along the front of the manifold 60 and around a corner to reach the left of the manifold 60. Alternatively, the circulation passage 862 may extend below the manifold 60 and around a corner to reach the left of the manifold 60. In this case, the presence of a descender is not essential.

In the dummy channel 802, the connecting position of the circulation passage 862 to the manifold 60 is away, in the right-left direction orthogonal to a longitudinal direction of the manifold 60, from the connecting position of the communication passage 822 to the manifold 60.

Ink returned from the dummy channel 802 to the manifold 60 is readily diluted with ink in the manifold 60, and is prevented from flowing immediately back to the dummy channel 802. Thus, ink in the dummy channel 802 is prevented from thickening.

Fourth Embodiment

Figure 8A:
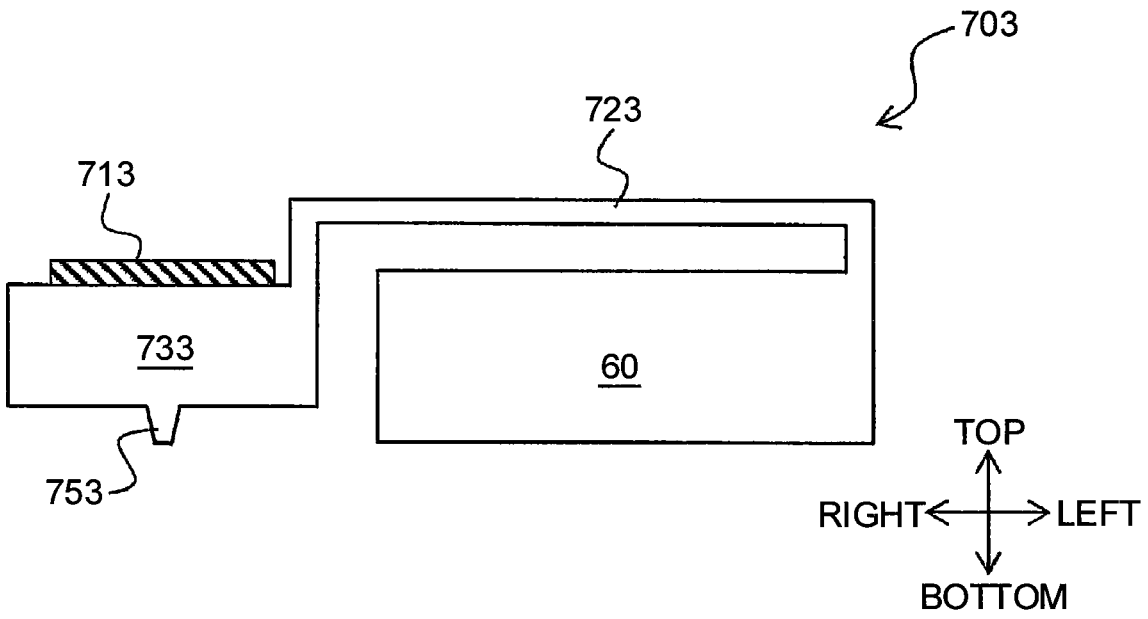
FIG. 8A is an enlarged cross-sectional view of an ejection channel of a liquid ejection head in a fourth embodiment according to one or more aspects of the disclosure.
Figure 8B:
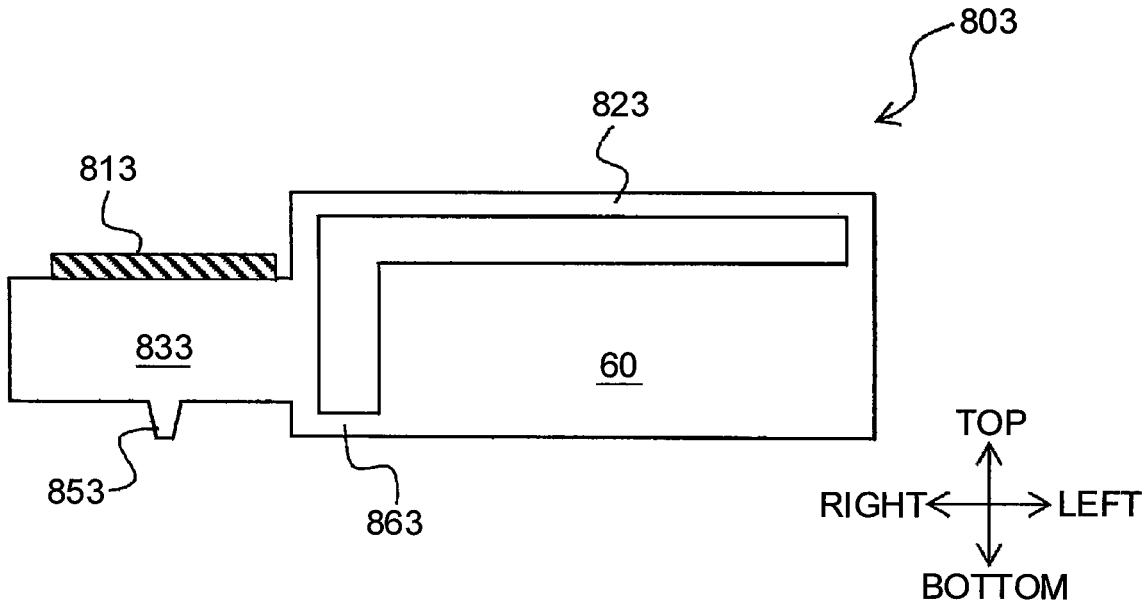
FIG. 8B is an enlarged cross-sectional view of a dummy channel of the liquid ejection head.

FIGS. 8A and 8B are each an enlarged cross-sectional view of a part of a liquid ejection head in a fourth embodiment. A laminate body including a plurality of plates, which define a path of an ejection channel 703 and a path of a dummy channel 803, is omitted from FIGS. 8A and 8B. In the fourth embodiment, none of the ejection channel 703 and the dummy channel 803 has a descender.

As shown in FIG. 8A, the ejection channel 703 defines a path extending from an outlet of a manifold 60, via a communication passage 723 and a pressure chamber 733, to an ejection nozzle 753. A vibration plate of an actuator 713 in FIG. 8A partially defines a wall of the pressure chamber 733. Upon application of a drive voltage to the actuator 713, the vibration plate deforms to change the capacity of the pressure chamber 733. The communication passage 723 connects the manifold 60 to the pressure chamber 733. An ejection nozzle 753 is directly connected to the pressure chamber 733.

As shown in FIG. 8B, the dummy channel 803 defines a path extending from an outlet of a manifold 60, via a communication passage 823 and a pressure chamber 833, to a dummy nozzle 853. Channel elements of the dummy channel 803, including an actuator 813 and the communication passage 823, are disposed similarly to the above-described ejection channel 703. A vibration plate of the actuator 813 partially defines a wall of the pressure chamber 833, similarly to the actuator 713.

The dummy channel 803 is characterized by a circulation passage 863. The pressure chamber 833 is in fluid communication with the manifold 60 through the circulation passage 863. The circulation passage 863 is located between the dummy nozzle 853 and the manifold 60. The circulation passage 863 is closer to the dummy nozzle 863 than to the actuator 813. Because of the lack of a descender, the circulation passage 863 connects a bottom portion of the pressure chamber 833 to the manifold 60. The communication passage 823 connects a top portion of the pressure chamber 833 to the manifold 60.

The liquid ejection head thus structured makes the ejection characteristics uniform among the ejection channels 703. When the actuator 813 is driven to such extent as not to cause ink ejection, ink in the dummy channel 803 flows back into the manifold 60 though the circulation passage 863. This prevents thickened ink in the dummy channel 803 from affecting the ejection characteristics of the ejection channel 703 next to the dummy channel 803.

An ink circulation direction in the dummy channel 803 may be set as in the dummy channel 80, by setting a driving signal and inertances Mo and Mi as described with reference to FIG. 5.

In the liquid ejection head in the fourth embodiment, the circulation passage 863 and the manifold 60 may be connected as described in the second embodiment shown in FIG. 6 or in the third embodiment shown in FIG. 7. In such cases, as advantageously as described above, a distance between the connecting position of the communication passage 823 to the manifold 60, and the connecting position of the circulation passage 863 to the manifold 60 is increased, thereby achieving dilution of thickened ink and supply of fresh ink in the dummy channel 803, and accordingly unifying the ejection characteristics among the ejection channels 703.

While the disclosure has been described in detail with reference to the specific embodiments, various changes, arrangements and modifications may be applied therein without departing from the spirit and scope of the disclosure.

What is claimed is:

1. A liquid ejection head comprising a body, the body comprising:

a manifold configured to store liquid therein;

a plurality of ejection channels each communicating with the manifold, and each configured to receive liquid from the manifold and eject liquid through a corresponding nozzle thereof open to a nozzle surface, wherein the plurality of ejection channels do not comprise a circulation passage within the body;

a dummy channel communicating with the manifold and including a dummy nozzle open to the nozzle surface, the dummy channel further including:

a pressure chamber;

an actuator configured to apply pressure to liquid in the pressure chamber;

a communication passage connecting the manifold to the pressure chamber; and a circulation passage through which the pressure chamber communicates with the manifold, the circulation passage being different from the communication passage and located between the dummy nozzle and the manifold.

2. The liquid ejection head according to claim 1, wherein the circulation passage is closer to the dummy nozzle than to the actuator.

3. The liquid ejection head according to claim 1, wherein the dummy channel further includes a descender connecting the pressure chamber to the dummy nozzle, and the circulation passage connects the descender to the manifold.

4. The liquid ejection head according to claim 1, a liquid inertance of the circulation passage is less than a liquid inertance of the dummy nozzle.

5. The liquid ejection head according to claim 1, wherein a liquid flow resistance of the dummy channel is equal to a liquid flow resistance of each of the plurality of ejection channels.

6. The liquid ejection head according to claim 1, wherein the manifold comprises a first edge, and wherein a connecting position of one of the plurality of ejection channels to the manifold is located between a connecting position of the circulation passage of the dummy channel to the manifold, and a connecting position of the communication passage of the dummy channel to the manifold, wherein both of the connecting position of the circulation passage of the dummy channel to the manifold, and the connecting position of the communication passage of the dummy channel to the manifold are on the first edge of the manifold.

7. The liquid ejection head according to claim 1, wherein the manifold is elongate in a first direction and has opposite ends in a cross-section thereof cut in a direction intersecting the first direction, and wherein the circulation passage of the dummy channel is connected to one of the opposite ends of the manifold, and the communication passage of the dummy channel is connected to the other of the opposite ends of the manifold.

8. The liquid ejection head according to claim 1, wherein the dummy channel is configured such that liquid flows from the manifold, via the pressure chamber and the circulation passage, back to the manifold.

9. The liquid ejection head according to claim 1, wherein the dummy channel and the plurality of ejection channels are arranged along the manifold in an array, and the dummy channel is located at an end of the array.

10. A liquid ejection apparatus comprising:

a liquid ejection head according to claim 1, and a driver integrated circuit configured to output a drive signal for driving the actuator, the drive signal being a pulse signal changing between a first potential v1, and a second potential v2, wherein the pressure chamber of the dummy channel is configured to have a first volume V1 when the drive signal applied to the actuator is at a first potential v1, and have a second volume V2 different from the first volume V1 when the drive signal applied to the actuator is at the second potential v2, wherein an inertance of a path located toward the circulation passage relative to the pressure chamber is different from an inertance of a path toward the communication passage relative to the pressure chamber, and wherein the driver integrated circuit is configured to output to the actuator a drive signal which takes a first time period t12 to change from the first potential v1 to the second potential and takes a second time period t21 to change from the second potential v2 to the first potential v1, the first time period t12 being different from the second time period t21.

11. The liquid ejection apparatus according to claim 10, wherein the driver integrated circuit is configured to output to the actuator the drive signal which takes the first time period t12 less than the second time period t21 in a case where the pressure chamber is configured to have the second volume V2 less than the first volume V1 and where the inertance of the path located toward the circulation passage relative to the pressure chamber is less than the inertance of the path located toward the communication passage relative to the pressure chamber.

12. The liquid ejection apparatus according to claim 10, wherein the driver integrated circuit is configured to output to the actuator the drive signal which takes the first time period t12 greater than the second time period t21 in a case where the pressure chamber is configured to have the second volume V2 less than the first volume V1 and where the inertance of the path located toward the circulation passage relative to the pressure chamber is greater than the inertance of the path located toward the communication passage relative to the pressure chamber.

13. A liquid ejection head comprising a body, the body comprising:

a plurality of nozzles open to a nozzle surface;

a manifold communicating with the plurality of nozzles;

a plurality of pressure chambers;

a plurality of channels each including a communication passage which connects a corresponding outlet of the manifold to a corresponding pressure chamber, and each extending from the corresponding outlet of the manifold, via the communication passage, to a corresponding nozzle, wherein the plurality of channels do not comprise a circulation passage in the body; and a plurality of actuators each partially defining a wall of a corresponding pressure chamber and configured to change a volume of the corresponding pressure chamber;

wherein the plurality of channels are arranged in an array, and wherein a channel located at an end of the array is a dummy channel, and the dummy channel defines a path extending from a corresponding outlet of the manifold to a corresponding nozzle and includes, in addition to a corresponding communication passage, a circulation passage which is located between the corresponding nozzle and the manifold and through which a corresponding pressure chamber communicates with the manifold.

14. The liquid ejection head according to claim 13, wherein the circulation passage of the dummy channel is located closer to the corresponding nozzle than to a corresponding actuator.

15. The liquid ejection head according to claim 13, wherein a liquid inertance of the circulation passage of the dummy channel is less than a liquid inertance of the corresponding nozzle of the dummy channel.

16. The liquid ejection head according to claim 15, wherein the plurality of channels include the dummy channel and ejection channels, and a liquid flow resistance of the dummy channel is equal to a liquid flow resistance of each of the ejection channels.

17. The liquid ejection head according to claim 13, wherein the dummy channel includes a descender connecting the corresponding pressure chamber to the corresponding nozzle, and the circulation passage connects the descender to the manifold.

18. The liquid ejection head according to claim 1, wherein the plurality of ejection channels further comprise:

a plurality of communication passages, wherein each of the plurality of communication passages comprises a first end and a second end, the first end opposite the second end, wherein the first end is configured to communicate with the manifold, and wherein the body extends from the second end of each of the plurality of communication passages to the nozzle surface.

19. The liquid ejection head according to claim 13, wherein the plurality of channels further comprise:

a plurality of communication passages, wherein each of the plurality of communication passages comprises a first end and a second end, the first end opposite the second end, wherein the first end is configured to communicate with the manifold, and wherein the body extends from the second end of each of the plurality of communication passages to the nozzle surface.

20. A liquid ejection head comprising:

a manifold configured to store liquid therein;

an ejection channel in communication with the manifold, the ejection channel comprising;

a nozzle;

a first pressure chamber;

a first actuator configured to apply pressure to liquid in the first pressure chamber; and a first communication passage configured to connect the manifold to the first pressure chamber; and a dummy channel in communication with the manifold, the dummy channel comprising;

a second pressure chamber;

a second actuator configured to apply pressure to liquid in the second pressure chamber;

a second communication passage configured to connect the manifold to the pressure chamber; and a circulation passage through which the second pressure chamber is configured to communicate with the manifold, the circulation passage being different from the second communication passage, wherein a number of the first communication passages is larger than a number of the circulation passages and a number of the second communication passages is larger than the number of the circulation passages.

* * * * *